United States Patent [19]

Lassmann

[11] Patent Number: 4,712,367

[45] Date of Patent: Dec. 15, 1987

[54] METHOD AND DEVICE FOR FORMING A THREAD JOINT

[75] Inventor: Manfred Lassmann, Nettetal, Fed. Rep. of Germany

[73] Assignee: W. Schlafhorst & Co., Monchen-Gladbach, Fed. Rep. of Germany

[21] Appl. No.: 794,757

[22] Filed: Nov. 4, 1985

[30] Foreign Application Priority Data

Nov. 2, 1984 [DE] Fed. Rep. of Germany ..... 3440009

[51] Int. Cl.[4] ..... D01H 15/02

[52] U.S. Cl. ..... 57/263; 57/261; 57/264

[58] Field of Search ..... 57/261–264, 57/22, 81

[56] References Cited

U.S. PATENT DOCUMENTS

| | | | |
|---|---|---|---|
| 4,007,457 | 2/1977 | Aeppli | 57/264 |
| 4,084,398 | 4/1978 | Stahlecker et al. | 57/263 |
| 4,102,116 | 7/1978 | Derichs et al. | 57/264 X |
| 4,137,699 | 2/1979 | Stahlecker et al. | 57/263 X |
| 4,150,530 | 4/1979 | Derichs | 57/263 |
| 4,168,604 | 9/1979 | Mannhart | 57/264 |
| 4,195,345 | 3/1980 | Artzt et al. | 57/264 X |
| 4,222,224 | 9/1980 | Raasch | 57/263 |
| 4,327,546 | 5/1982 | Derichs et al. | 57/263 |
| 4,472,933 | 9/1984 | Raasch et al. | 57/263 |

*Primary Examiner*—John Petrakes

*Attorney, Agent, or Firm*—Herbert L. Lerner; Laurence A. Greenberg

[57] ABSTRACT

A method of forming a thread joint in an open-end spinning machine having a sliver drawing-in device for drawing in a sliver and feeding it to a fiber loosening device from which it is guided by a fiber guiding device to a fiber accumulator at which the fibers are accumulated, disentangled, imparted with a rotary motion, and thereafter engaged with an open end of a thread, and a take-up device for drawing the thread out of the fiber accumulator includes for the purpose of joining a joint, bringing a thread end which is fed back into the fiber accumulator into contact with a quantity of fibers to be joined which have been previously fed into the fiber accumulator, continuously withdrawing the thread out of the fiber accumulator and continuously feeding fibers into the accumulator, continuously measuring the quality of the joints and automatically controlling, in accordance with the quality, the quantity of fibers being joined.

20 Claims, 5 Drawing Figures

METHOD AND DEVICE FOR FORMING A THREAD JOINT

Figure 1:
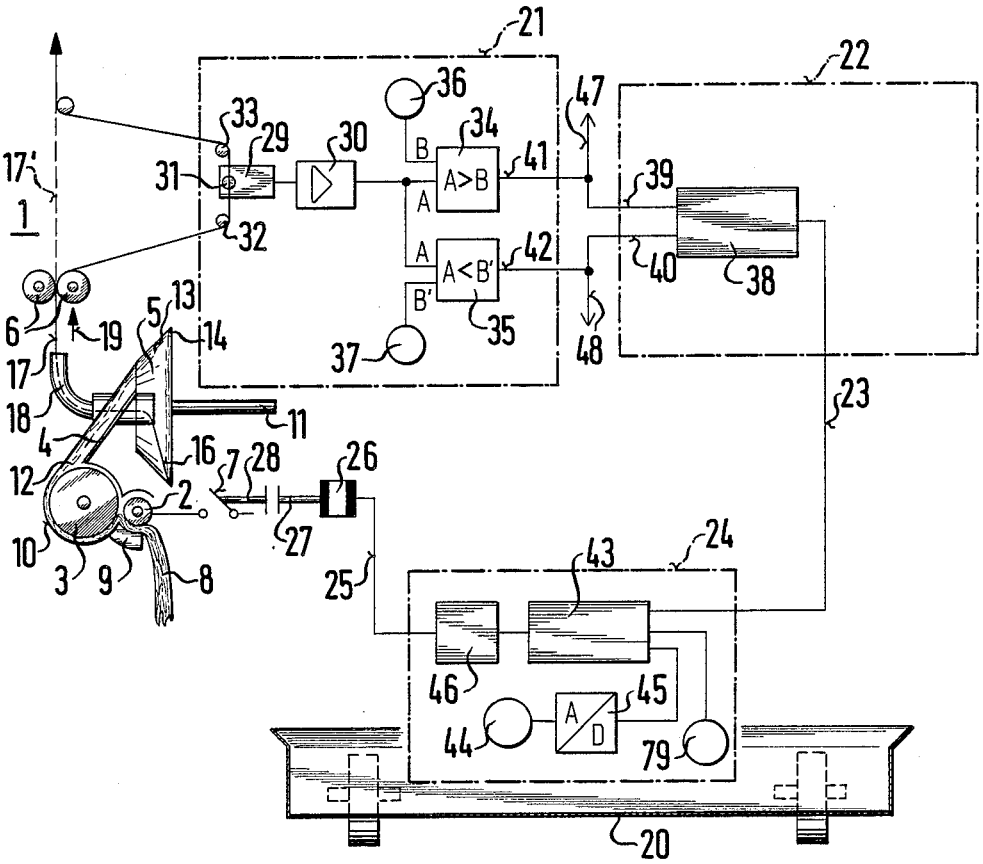

The invention relates to a method and a device for forming a thread joint or piecing a thread, more particularly, in an open-end spinning unit having a sliver drawing-in device for drawing in a sliver and feeding it to a fiber loosening device from which it is guided by a fiber guiding device to a fiber accumulator at which the fibers are accumulated, disentangled, imparted with a rotary motion, and thereafter engaged with an open end of a thread, and a take-up device for drawing the thread out of the fiber accumulator.

In this regard, the type of fiber accumulator for use in the invention of the instant application is of secondary importance. As is generally known, there are many differently constructed fiber accumulators, and there are correspondingly different ways for a fiber accumulator to impart a rotary motion of the fibers. If the fiber accumulator is, for example, constructed as a rotor and the latter has a fiber collecting groove, the fibers then lay themselves out lengthwise in the fiber collecting groove and encircle the rotary axis of the fiber accumulator. In other fiber accumulators, the fibers are, for example, imparted with rotary motion about the longitudinal axes thereof.

Especially in the case of an open-ended rotary spinning machines, it is of importance for the quality of the joint, as to what peripheral speed the fiber accumulator in fact rotates at, during the instant in which the fed back thread end contacts the quantity of fibers to be joined which are present in the fiber accumulator, and as to how great the quantity of fibers to be joined actually is during that instant.

Various possibilities exist for determing beforehand the quantity of fibers to be joined, for example, in accordance with the draft selected for the spinning operation or process or in accordance with other criteria.

In this regard, it is already difficult to attain a good quality of the joint from the start and it is at least just as difficult, for an insufficient joint quality, to change the correct influencing parameters by the correct amount in order finally to achieve good joints. In this regard, deviations from spinning unit to spinning unit of one and the same machine and deviations over time must be taken into account so that one must continuously measure and correct if one wishes to maintain the quality of the joints lastingly at high level.

It is accordingly an object of the invention to provide a method and device for forming good joints rapidly even under undesirable conditions and then to maintain them at a high quality level so that the number of unsuccessful joining attempts are diminished.

With the foregoing and other objects in view, there is provided, in accordance with one aspect of the invention, a method of forming a thread joint in an open-end spinning machine having a sliver drawing-in device for drawing in a sliver and feeding it to a fiber loosening device from which it is guided by a fiber guiding device to a fiber accumulator at which the fibers are accumulated, disentangled, imparted with a rotary motion, and thereafter engaged with an open end of a thread, and a take-up device for drawing the thread out of the fiber accumulator, which comprises, for the purpose of forming a joint, bringing a thread end which is fed back into the fiber accumulator into contact with a quantity of fibers to be joined which have been previously fed into the fiber accumulator, continuously withdrawing the thread out of the fiber accumulator and continuously feeding fibers into the accumulator, continuously measuring the quality of the joints and automatically controlling, in accordance with the quality, the quantity of fibers being joined. The quality of the joint is measured especially with respect to mass per unit length and/or thick location and/or thin location and/or yarn number.

In accordance with another mode of the invention, the method includes the quality of the joints is continuously measured by comparing a number of too-thick joints measured in a given time period with a number of too-thin joints measured in the same time period, reducing the quantity of fibers to be joined when a preponderance of the too-thick joints are measured, and increasing the quantity of fibers to be joined when a preponderance of the too-thin joints are measured, and maintaining unchanged the quantity of fibers to be joined when, within a prescribed tolerance, a substantially equal number of too-thin and too-thick joints are measured in the given time period. From case to case, time periods of varying length, predetermined time intervals or time periods resulting from predetermined time intervals may be involved.

This particular mode of the method is especially worthy of recommendation wherein a thick location and also a thin location always initiate a cleaning process, which means, that the joint is removed each time and a new joining operation is released with the object of finally attaining a good joint even after two to three joining attempts. The method according to the invention thus reduces the number of unsuccessful joining attempts to a minimum value.

Because the joint quality depends upon how many fibers are actually at the joining location and whether exceedingly longer or exceedingly shorter fibers are involved, correction oscillations could result which are avoided when, in accordance with a further mode of the invention there is provided a method which includes automatically performing a continuous addition of joints exceeding the quality tolerance, thick joints having a positive value and thin joints having a negative value and, when a prescribed difference is exceeded, automatically changing the quantity of fibers to be joined, interrupting the continuous addition and newly beginning the continuous addition once again. So long as the thin locations and thick locations maintain the weight, it is assumed that the number of the neither too-thin nor too-thick joints is a maximum. No change then occurs in the quantity of fibers being joined. If, for example, after four or five thin locations, a like number of thick locations follows, the quantity of fibers being joined is not changed. If, however, for example, six thick locations follow five thin locations, the prescribed difference can already be exceeded. Consequently, a correction takes place, for example, automatically by a given amount.

In accordance with an added mode of the invention there is provided a method which includes measuring the corrected quantity of fibers provided for the respective reduction and increase in the quantity of fibers to be joined, automatically, inversely proportional to the number of joints exceeding the quality tolerance and included in the addition during at least one of the continous and preceding addition processes. In this mode of the inventive method, a suitably large correction is caused from the start. If, for example, thin locations and thick locations maintain the weight for a long time and then first exceed the prescribed difference, this means that only a quite small correction should be undertaken. If the prescribed difference has been reached very rapidly, on the other hand, then in the extreme case if, for example, only thin locations or thick locations occur, an especially great correction step is taken in accordance with the invention. In this manner, qualitatively good joints are again rapidly attained and few faulty joints are formed.

Instead of only including those joints in the addition which occur as thin locations or thick locations, in accordance with an additional mode of the method of the invention, which includes measuring corrected quantity of fibers provided for the respective reduction and increase in the quantity of fibers to be joined, automatically inversely proportional to the number of all of the joints measured during an addition process which has just ended. It could indeed be that the predominant majority of all the joints is already qualitatively good and that then, however, suddenly stray faulty joints occur, whereupon, if no correction is made, good joints would probably come on again. Because, in such a case, however, the amount of correction is very small, occasional faulty joints cannot cause any undue correction oscillations.

In lieu thereof, in accordance with yet another mode of the method of the invention, which includes measuring the corrected quantity of fibers provided for the respective reduction and increase in the quantity of fibers to be joined, automatically proportional to a mean thread signal of the joints measured during an addition process which has just ended.

Independently of the spinning conditions and of the employed fiber material, it may happen that a very uniform yarn is spun and, accordingly, also no great deviations in quality of the joints will occur. In this case, it may be more desirable if, in accordance with yet a further mode of the invention, which includes maintaining a prescribed corrected quantity of fibers within tolerance limits with each change of the quantity of fibers to be joined. This means that the respective corrected quantity of fibers is so measured that, because of its size, it has not yet started any control oscillations and that it is, nevertheless, large enough to attain adequate correction in one or more correction steps.

In accordance with still another mode according to the invention, the method which includes measuring the quality of the joints by determining the mass per unit length for each joint, forming a mean value from the measured values of a plurality of the joints and comparing it with the mass per unit length of the thread, and changing the quantity of fibers to be joined in proportion with the deviation in the mass.

In this mode of the method, the quantity of fibers to be joined is varied until the joint has the desired quality. With changes in the thread mass per unit length, the joints also change proportionally due to the correction.

In accordance with a further mode of the invention, the method includes measuring the mass per unit length at the traveling thread. This applies both for the measurement of the joint as well as the measurement of the thread. Conventionally, the mass per unit length is measured indirectly, for example, so that the thread runs through an electric plate condenser, and the mean capacitance during the measuring period is a measure for the mean mass of the thread section which has run through during the measuring period.

Alternatively, an opto-electrical thread measurement is employed in specific cases.

In accordance with another aspect of the invention, there is provided, in accordance with the invention, a joining device capable of traveling and forming a joint in an open-end spinning machine having a sliver drawing-in device for drawing in a sliver and feeding it to a fiber loosening device from which it is guided by a fiber guiding device to a fiber accumulator at which the fibers are accumulated, disentangled, imparted with a rotary motion, and thereafter engaged with an open end of a thread, and a take-up device for drawing the thread out of the fiber accumulator, a thread end being feedable, for the purpose of forming a joint, back into the fiber accumulator into contact with a quantity of fibers to be joined which had been previously fed into the fiber accumulator, the thread being continuously withdrawable from he fiber accumulator and fibers being continuously feedable into the fiber accumulator, the joining device comprising an automatic joint quality measuring device connected to a joint quality monitor, and a metering device for quantities of fibers to be joined which is controllable in accordance with a means quality of the joints, the metering device being operatively connected to the quality monitor.

Because the joining device is movable relative to the open-ended spinning machine, in accordance with another feature of the invention, the metering device for the quantities of fibers has a detachable operative connection with the sliver drawing-in device of the open-end spinning machine. Such a detachable operative connection is formed, for example, of a forwardly thrustable and withdrawable plunger which acts upon a switch which switches the sliver drawing-in device on and off.

In accordance with a further feature of the invention the automatic joint quality measuring device has a thread signal receiver with an output connected to a comparator responsive to at least one thread signal deviating from those for normal thread values, the comparator has an output to which a mean value former of the quality monitor is post connected. The thread signal receiver is provided primarily for receiving those thread signals which issue from a joint.

In accordance with an added feature of the invention the joint quality monitor has an up/down counter with an up-input connected to an output of a comparator responsive to relatively thick locations of the thread, a down-input connected to an output of a comparator responsive to relatively thin locations of the thread and forming part of the automatic joint quality measuring device, and an output connected to the metering device for quantities of fibers to be joined. The up/down counter responds only to those signals which the comparators let through. In this regard, each of the signals let through by the respective comparators, simultaneously activate a cleaner section and the formation of a new joint, respectively.

In accordance with an added feature of the invention, the up/down counter is capable of emitting a fiber-quantity increasing signal when a zero value is reached and jumping to a prescribed output counter value located between zero value and a selective over-run value, and the up/down counter being capable of emitting a fiber-quantity reducing signal when the over-run value is reached and likewise jumping to the output counter value. If the over-run value 8, 9 or 10 is selected, for example, then desired output counter values are at 4 or 5.

In accordance with an additional feature of the invention there is provided a corrected quantity adjuster connected to the metering device for quantities of fibers to be joined.

The corrected quantity adjuster can be controllable automatically and, to this end, in accordance with an additional feature of the invention, the corrected quantity adjuster is connected to the output of the thread signal receiver and to the output of the joint quality monitor and is capable of emitting a correction signal inversely proportional to the number of the joints measured during a just-ended counting process of the up/-down counter.

The size of the correction signal is thereby directed thus towards the entire number of the joints occurring during the counting process, whether they are then counted with or not.

In accordance with yet another feature of the invention, a corrected quantity adjuster is connected to the metering device for quantities of fibers to be joined, and wherein the corrected quantity adjuster is connected to the outputs of the comparators and to the output of the joint quality monitor, and is capable of emitting a correction signal inversely proportional to the number of joints which are beyond the quality tolerance and which are measured during a just-ended counting process of the up/down counter. In this case, with the measurement, the correction, thus the "good" joints located within the quality limits, remain unconsidered.

In accordance with yet a further feature of the invention the joint quality monitor has at least one device for integrating the joint signals, one device for prescribing, similating or integrating the thread signals and a comparator device post connected to both of the last-mentioned one devices. That which matters is that the integrated joint signals are to be compared with the integrated thread signals. These integrated can also be prescribed or simulated. Whichever is better in the individual case depends upon the spinning conditions as a whole.

In accordance with yet an additional feature of the invention, the joint quality monitor has a first integrator connected in a series-parallel circuit with a first comparator and a second comparator, as well as a second integrator in a series-parallel circuit with the first and the second comparators, the integrators having inputs connected to the joint quality measuring device, and the outputs of the comparators being connected to the metering device for quantities of fibers to be joined.

In accordance with a concomitant feature of the invention, the input of the first integrator is connected to a first thread signal receiver, and the input of the second integrator to a second thread signal receiver.

Other features which are considered as characteristic for the invention are set forth in the appended claims.

Although the invention is illustrated and described herein as embodied in a method and a device for forming a thread joint, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIGS. 1 to 5 are diagrammatic views of the thread joining device according to the invention showing schematically respectively different embodiments of circuits for operating the device.

Referring now to the drawing and, first, particularly to FIG. 1 thereof, there is shown an open-end spinning machine having a multiplicity of open-end spinning units 1 respectively including a sliver drawing-in device 2, a fiber loosening device 3, a fiber guiding device 4, a fiber accumulator 5 and a draw-off device 6. The sliver drawing-in device 2 is formed of a drawing-in roller driven by an electric motor. A switch 7 is preconnected to the electric motor. The sliver 8 travels over a feed table 9 and under the drawing-in roller to the loosening device 3 which is in the shape of a rotating, toothed or serrated roller. The fiber guiding device 4 is formed as a fiber channel which extends from a housing 10 of the loosening device 3 to the fiber accumulator 5. The fiber accumulator 5 is formed as a rotor which is seated on a shaft 11. Threads 12 which are isolated or individually separated by the loosening device 3 initially reach a slide surface 13 having a conically shaped casing and extend from there into fiber collector grooves 14 formed in the rotating fiber accumulator 5.

The fiber accumulator 5 sets the fibers disposed in the fiber collector grooves 14 into rotary motion. They rotate about a common rotary axis of the shaft 11 and the fiber accumulator 5 so that the fibers dispose themselves lengthwise in the fiber collector grooves 14.

In the fiber collector grooves 14, the fibers located therein are pieced or joined to a thread end 16. A thread 17 to which the end 16 belongs is continuously drawn off by means of the draw-off device 6 through a thread take-off tube 18 in direction of the arrow 19. The draw-off device 6 is formed of a roller pair.

During a normal spinning operation, the thread 17 follows the broken line 17'. It is continuously wound on an otherwise nonillustrated cheese or crosswound coil. The draw-off device 6 can be changed from forward motion to backward or reverse motion for the purpose of effecting the piecing or joining and the return of the thread into the fiber accumulator 5.

A traveling thread piecing or joining device 20 is operatively associated with the open-end spinning machine. The thread joining device 20 travels from spinning unit to spinning unit and is able automatically to perform a piecing or joining operation after a thread break has occurred or a first-time piecing or joining operation. For this purpose, the joining device 20 remains standing in front of the respective spinning unit and performs the individual activities required for piecing or joining, in accordance with a given program, for example, controlled by a system of cams.

FIG. 1 shows in a diagrammatic and schematic view only those parts of the joining device 20 which are important for an understanding of the invention. A thread-joiner quality monitor 22 is connected to an automatically operating thread-joiner quality measuring device 21 and has an operative connection 23 with a metering device 24 for the quantity of joining or piecing fibers which is controllable in accordance with the mean quality of the thread joint. A releasable or detachable operating connection with the switch 7 of the sliver drawing-in device 2 is formed by a line 25 and an electromagnetic drive 26. The connection is formed when the electromagnetic drive 26 drives a plunger 27 out which acts mechanically upon another plunger 28 of the switch 7 with the objective of turning the switch 7 on or, after drawing the plunger 27 back, with the objective of turning the switch 27 off again.

The automatic thread-joining quality measuring device 21 is provided with a thread signal pickup or receiver which is formed of a measuring head 29 and an amplifier 30. The thread signal receiver 29,30 has as its function the receiving or picking up of the thread signals originating from a thread joint 31. In order to make the thread joint 31 visible on the whole, it is shown exaggeratedly enlarged in FIG. 1. With the aid of a pair of thread guides 32 and 33, the thread 17 is diverted out of its travel path and guided through the measuring head 29 for the purpose of picking up the thread signal. Reference may be had to U.S. Pat. No. 4,327,546 to Derichs et al dated May 4, 1982 which describes the formation of the path of the thread during the joining operation. Two comparators 34 and 35 are postconnected to the amplifier 30. The comparator 34 is responsive to relatively thick locations while the comparator 35 is responsive to relatively thin locations. The limiting value of a thick location is adjustable to a limiting value transmitter 36 while the limiting value of a thin location is adjustable to a limiting value transmitter 37.

The thread-joint quality monitor 22 has an up/down counter 38, the up-input 39 of which is connected to an output 41 of the comparator 34 which is responsive to thick locations. A down-input 40 of the up/down counter 38 is connected to an output 42 of the comparator 35 which is responsive to thin locations. The operative connection 23 is connected to the output of the up/down counter 38 and leads to the piecing or joining sliver metering device 24.

The joining or piecing sliver metering device 24 includes a computer 43 which, starting from a base value of the quantity of fibers in the joining sliver, converts the correction signals introduced via the operative connection 23 into control signals for the electromagnetic drive 26. The base value of the amount of joining-sliver fibers can be adjusted to a nominal-value transmitter 44. The nominal value transmitter 44 is connected to the computer 43 via an analog/digital converter 45. The corrected fiber quantity value in the case of the respective decrease or increase in the quantity of fibers in the joining sliver is introduced into the computer 43 through a nominal value transmitter 79. From an output of the computer 43, a line 25 extends via a signal converter 46 which selectively emits analog or digital control signals as correction signals for the silver drawing-in device 2. The quality of the joint 31 is determined, for example, capacitively, as it travels through the measuring head 29, the measuring signal is amplified and fed to the two comparators 34 and 35. If the joint 31 meets the quality requirements or representations, no signal is issued by either of the two comparators. No change is accordingly made in the joining quantity of fibers, and it remains the same as it would be when set to the nominal value transmitter 44. If the comparator 34 determines, however, that the joint 31 is to be considered to be a thick location, it issues a signal via the output 41 thereof which, via a line 47, triggers or activates a non-illustrated cleaner section and causes a repetition of the joining or piecing operation. Simultaneously, the signal is transmitted via the up input 39 to the up/down counter 38 which, for example, may be set at the number 5. The counter then jumps to the number 6. As before, no signal is transmitted any farther via the operative connection 23.

If the thread joint is in order, the two thread guides 32 and 33 deliver the thread 17 into the normal travel path 17' thereof, and the joining or piecing device 20 travels farther upon demand or on a search or hunt of its own to a different spinning unit. At the latter non-illustrated spinning unit, it repeats the foregoing process after the joining or piecing operation and, if the comparator 35 then, for example, determines that a thin location is present at the joint 31, a signal is transmitted via the output 42 which likewise triggers a cleaner section via a line 48 and causes a repetition of the piecing or joining operation. The signal goes simultaneously via the down-input 40 into the up/down counter 38 which then, for example, jumps back from the number 6 to the number 5.

From spinning unit to spinning unit, the forward and backwards or upwards and downwards jumping of the counter 38 for one or more values can repeat for some time without reaching zero value or the preselected overrun value.

The instant the up/down counter 38 has reached zero value, however, it issues a fiber-quantity increase signal via the operative connection 23 and jumps back by itself to the predetermined output counted value, for example, to the value 5. The fiber-quantity increase signal becomes triggered in the last-mentioned case because, theretofore, more thin locations than thick locations among the thread joints were beyond the quality tolerance. The computer 43 then assumes the task of increasing by a predetermined amount the quantity of fibers in the pieced or joined sliver which is adjusted to the nominal value transmitter. This is effected, for example, by increasing the length of the period that the electromagnetic drive 26 is switched on. The longer the electromagnetic drive 26 remains switched on, the longer it also keeps the switch 7 switched on and the longer the sliver drawing-in device 2 runs so as to feed the sliver 8 to the fiber loosening device 3. The latter, in turn, feeds or advances a somewhat greater quantity of fibers into the fiber collecting grooves 14, and this increased quantity of fibers finally also reinforce or thickens the joint 31 which develops the instant a thread is returned into the fiber accumulator 5 by running back through the drawing-in device 6, so that the end of the thread engages the fiber ring disposed in the fiber collecting groove 14.

If the thick locations were exceeded, the up/down counter 38 would run over, for example, when the counter value reaches 10, and would transmit a fiber-quantity reduction signal via the operative connection 23. Thereafter, the counter value would also drop down to the starting counter value, for example, the value 5. The computer 43 would have evaluated the fiber-quantity reduction signal by reducing the switched-on time of the electromagnetic drive 26 by a predetermined value, for example, expressed in seconds or fractions of seconds. Alternatively, in another example, the rotary speed of a motor or the adjustment angle of a stepping motor, which frictionally acts upon the sliver drawing-in device, could be varied.

Figure 3:
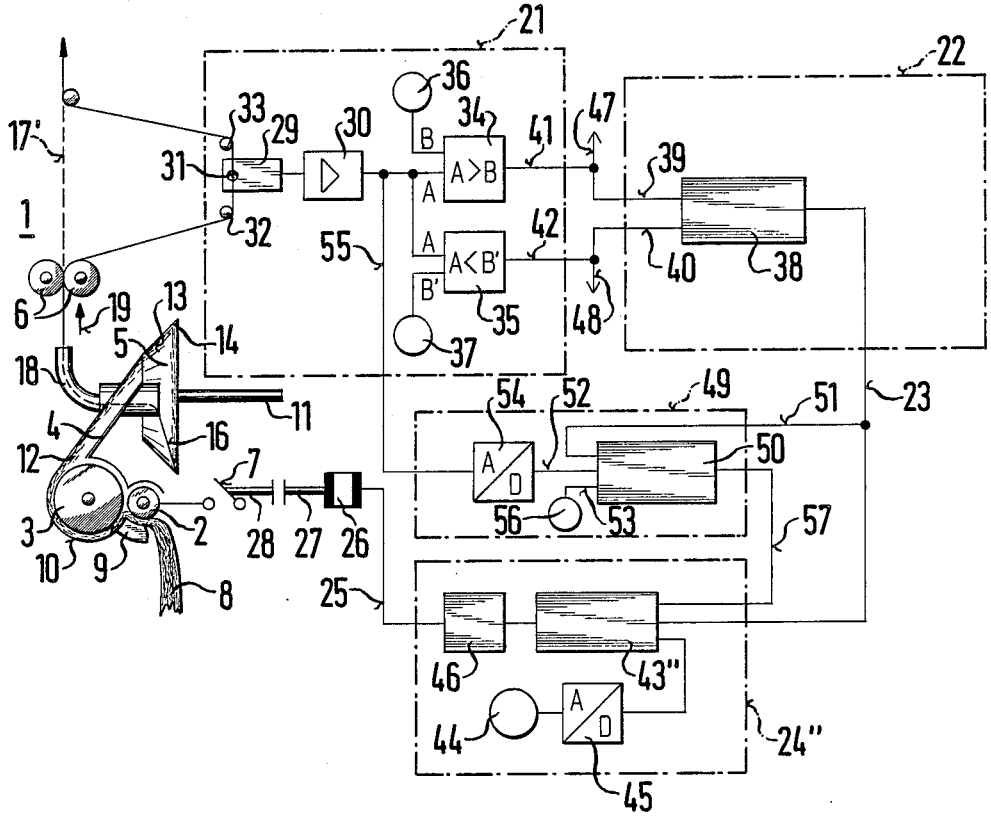

The corrected switched-on time of the electromagnetic drive 26 remains unchanged until the counter 38 again reaches or exceeds zero value. In the embodiment of the invention according to FIG. 3, the following differences exist with respect to the embodiment of FIG. 1:

The metering device for the quantity of the fibers being joined, which is identified in FIG. 3 by the reference character 24". is connected to a corrected quantity adjuster 49 which has as its function to adjust to the most desirable corrected quantity from case to case and to present it to the computer 43" of the joining fiber-quantity metering device 24".

The corrected quantity adjuster 49 in FIG. 3 includes a computer 50 with three inputs 51, 52 and 53. The input 52 is connected via and analog/digital converter 54 and a line 55 to the output of the thread signal pick-up or receiver 29, 30. The input 51 is connected to the operative connection 23 and therewith to the output of the joint quality monitor 22. The input 53 is connected to a nominal value transmitter 56. The computer 50 receives a pulse via the input 52 for each measured joint 31. It counts these pulses received during a counting process of the up/down counter 38. The beginning and the end of the counting process are introduced into the computer 50 via the input 51. The computer 50 issues a correction signal which is inversely proportional to the number of joints measured during the counting process, the signal being conducted via an operative connection 57 to the input of the computer 43" of the metering device 24" for the quantity of fibers being joined. At the nominal value transmitter 56, the correction signals can be varied percentagewise with respect to the amplitude thereof, for example. The computer 43" then measures the change in the quantity of fibers being joined, after correction jumps which the computer 50, respectively, provides. Otherwise, the embodiment of FIG. 3 is constructed like the embodiment of FIG. 1.

Figure 4:
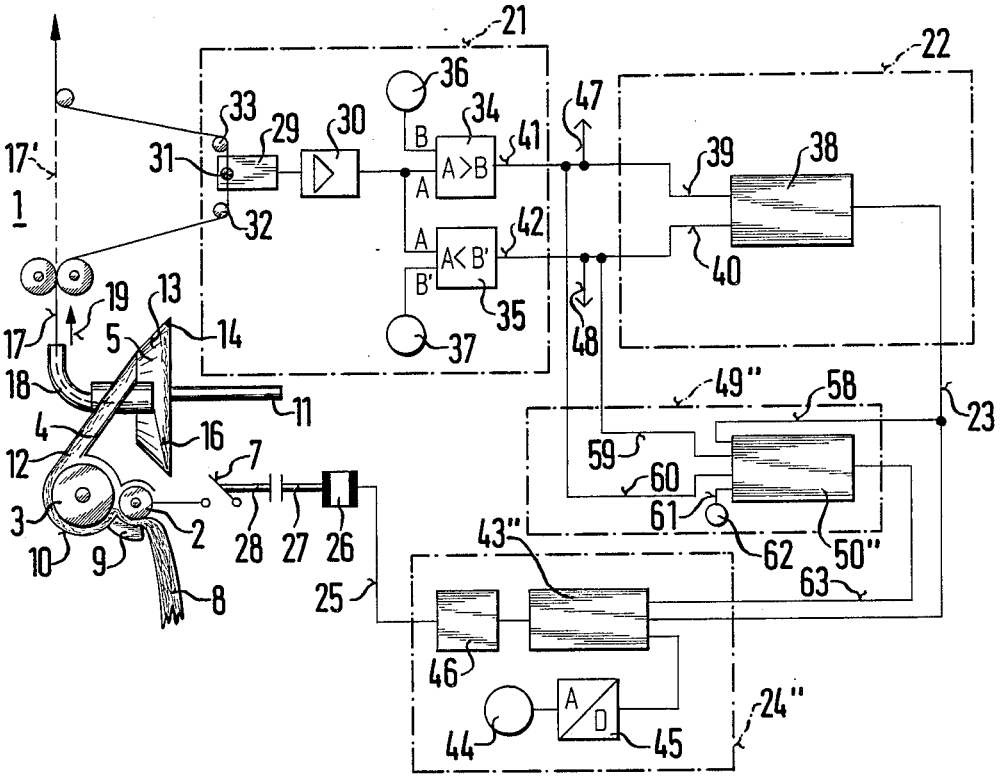

The embodiment of FIG. 4 is provided with a corrected quantity adjuster 49" similar to the embodiment of FIG. 3. The corrected quantity adjuster 49" has a computer 50" with four inputs 58 to 61. The input 59 is connected to the output 42 of the comparator 35, and the input 60 to the output 41 of the comparator 34. The input 58 is connected to the operative connection 23 and therewith to the output of the joint quality monitor 22. The input 61 is connected to a nominal value transmitter 62. The computer 50" counts the number of joints lying beyond the quality tolerance and measured during the counting process, and emits a correction signal inversely proportional to the number of these joints, the magnitude of the signal being determined percentagewise via the nominal value transmitter 62. The end of a counting process and the beginning of a new counting process is fed to the computer 50" via the input 58. An operative connection 63 exists between the output of the computer 50" and the computer identified in FIG. 4 by the reference character 43" of the metering device for the quantity of fibers to be joined which is identified in FIG. 4 by reference character 24".

Otherwise, the embodiment according to FIG. 4 is constructed like that of FIG. 1.

Figure 5:
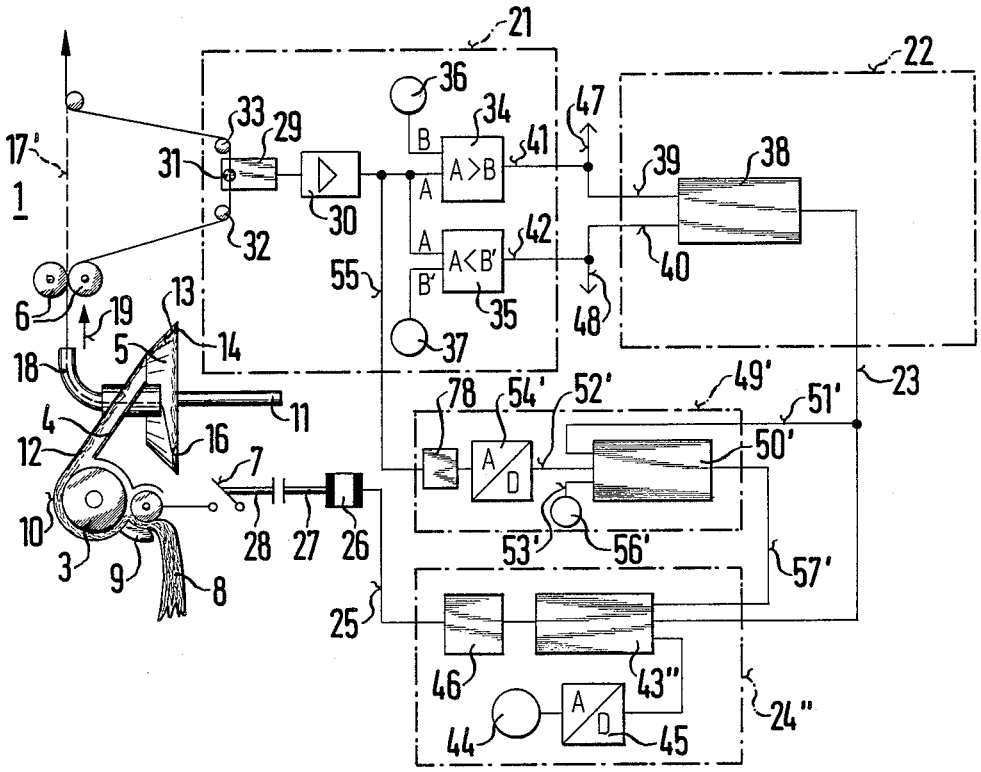

In the construction of the embodiment of FIG. 5, the following differences with respect to the embodiment of FIG. 3 exist:

The metering device for the quantity of fibers being joined, which is identified in FIG. 5 by the reference character 24" is connected to a corrected quantity adjuster 49'. The corrected quantity adjuster 49' has the function of adjusting to the most desirable corrected quantity from case to case and to feed it to the computer 43" of the metering device 24".

The corrected quantity adjuster 49' includes a computer 50' with three inputs 51', 52' and 53'. The input 52' is connected via an analog/digital converter 54', an integrator 78 and a line 55 to the output of the signal pick-up or receiver 29, 30. The input 51' is connected to the operative connection 23 and therewith to the output of the joint quality monitor 22. The input 53' is connected to a nominal value transmitter 56'. The integrator 78 receives the thread signals of the joints via the line 55. The computer 50' receives a pulse for each measured joint 31. The computer 50' divides the result of the integration through the number of pulses received during a counting process of the up/down counter 38. The beginning and ending of the counting process is introduced into the computer 50' via the input 51'. The computer 50' emits a correction signal proportional to the mean thread signal of the joint measured during the counting process, the correction signal being conducted via an operative connection 57' to the input of the computer 43" of the metering device 24" for the quantity opf fibers being joined. At the nominal value transmitter 56', the correction signals can be varied percentagewise, for example, with respect to the magnitude thereof. The computer 43" then measures the change in the quantities of fibers to be joined after correction jumps which are provided thereto, respectively, by the computer 50'.

Figure 2:
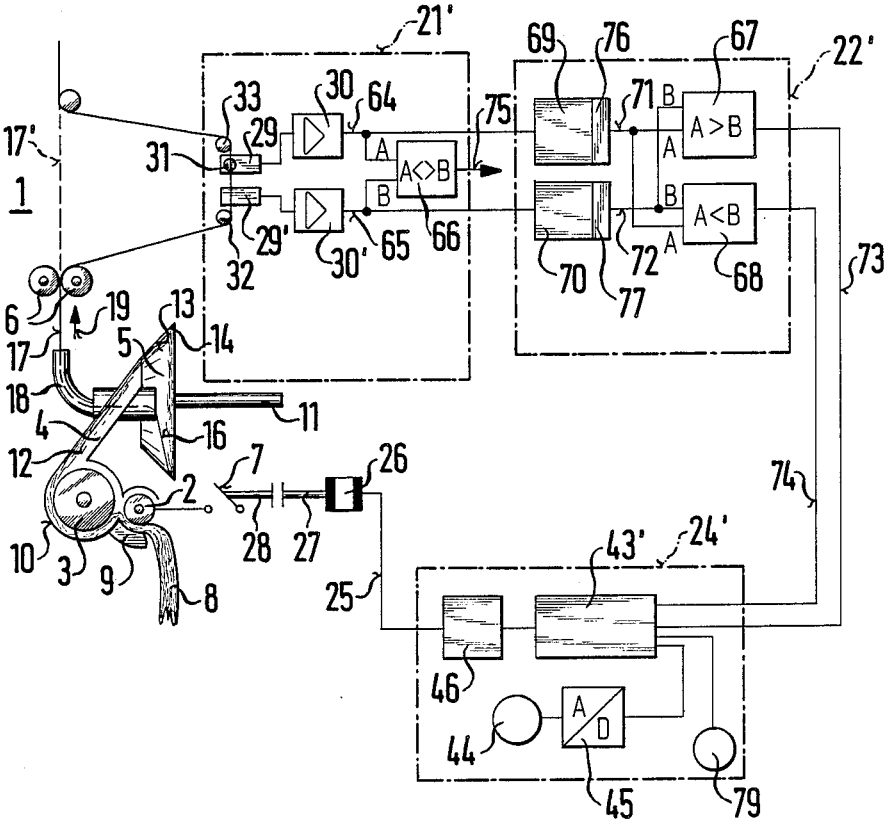

In the embodiment of the invention according to FIG. 2, all of the parts of the open-end spinning unit 1 shown in FIG. 1 are also provided. A joint quality monitor 22', followed by a metering device 24' for quantities of fibers being joined, is connected to the joint quality measuring device identified in FIG. 2 by the reference character 21'.

The joint quality measuring device 21' includes the thread guides 32 and 33 as known from FIG. 1, as well as the thread signal pick-up or receiver likewise known from FIG. 1 and formed of the measuring head 29 and the amplifier 30. In addition, a second thread signal receiver is provided which is formed of the measuring head 29' and the amplifier 30'. The first thread signal receiver 29, 30 picks up the signal of the joint 31, and the second thread signal receiver 29, 30' the signal of the thread 17. The output 64 of the amplifier 30 is connected to a comparator 66 and to a first integrator 69. The output 65 of the second amplifier 30' is connected to the same comparator 66 and to an integrator 70. The output 71 of the integrator 69 is connected to inputs of two comparators 67 and 68. The output 72 of the second integrator 70 is connected to inputs of the same comparators 67 and 68. An operative connection 73 extends from the comparator 67 and a further operative connection 74 from the comparator 68 to the computer 43' of the metering device 24' for the quantities of fibers being joined.

The comparator 66 is so adjusted that whenever the signal of the joint 31 deviates from the signal of the thread by a prescribed tolesrance, a thread-cleaner signal is emitted via a line 75 with the result that the thread is severed and a new joining process is initiated. Deviations below the tolerance are disregarded.

The integrator 69 is provided with an adder 76. The integrator 69 is thereby able to issue an aggregate signal via the output 71. The integrator 70 is also provided with an adder 77 and is therefore able also to issue an aggregate signal via its output 72. The comparator 67 is responsive if the aggregate signal coming from the adder 76 and above a prescribed tolerance is greater than the aggregate signal coming from the adder 77. Deviations below the tolerance are disregarded. Because this means that the joint is thicker than is desired, a signal to reduce the quantity of fibers being joined is transmitted via the operative connection 73 to the computer 43'. The comparator 68 is responsive if the signal coming from the adder 76 and greater than a prescribed tolerance is smaller than the signal coming from the adder 77. Deviations below the tolerance are disregarded. Because this means that the joint on average is thinner than desired, a signal to increase the quantity of fibers being joined is transmitted via the operative connection 74 to the computer 43'. In the description of FIG. 2, those parts which are not specifically mentioned are the same as those of similar reference numerals shown in FIG. 1 and described hereinbefore.

As mentioned hereinbefore, the invention is not limited to the embodiments represented and described herein.

In the embodiments of the invention, the computers receive analog signals via analog/digital converters. Alternatively, digital signals can however be fed thereto as well to provide nominal values or measurement signals. Analog/digital converters would be superfluous in such cases.

In the embodiments according to FIGS. 1 and 2, the nominal value entry of the corrected fiber quantities which are applicable or important to the respective metering devices 24 and 24' for the quantities of fibers being joined, occurs digitally by hand through nominal value transmitters 79. In lieu thereof, the possibility exists of deriving from spinning conditions, such as, for example, draft, turning or twist and takeup speed, applicable quantities of fibers being joined which must be taken into consideration with a change in the quantity of fibers being joined, and to introduce them as variable nominal values digitally or analogically via analog/digital converters into the respective computers 43 and 43'.

In the embodiments described hereinbefore, the limiting values are introduced into the comparators of the joint quality measuring devices by means of manually adjustable limiting value transmitters. In lieu thereof, the possibility is also afforded of deriving these limiting values from thread signals which are picked up by a measuring head connected at least temporarily to the limiting value transmitter. In this regard, for example, the same measuring head 29 which receives the thread signals of the joint is suitable. A time sequence can be maintained so that the measuring head, for example, measures the thread first and the limiting value transmitter is adjusted in accordance with the thread signal. Thereafter, the same measuring head measures the thread signal of the joint. The time sequence can be derived, for example, from the measured rotary angle of a take-up roller of the take-up device, quite like the beginning and the ending of a respective measuring process. In this regard, when the thread signal is measured, the joint cannot be missed.

I claim:

1. Method of forming a thread joint in an open-end spinning machine having a sliver drawing-in device for drawing in a sliver and feeding it to a fiber loosening device from which it is guided by a fiber guiding device to a fiber accumulator at which the fibers are accumulated, disentangled, imparted with a rotary motion, and thereafter engaged with an open end of a thread, and a take-up device for drawing the thread out of the fiber accumulator, which comprises, for the purpose of forming a joint, bringing a thread end which is fed back into the fiber accumulator into contact with a quantity of fibers to be joined which have been previously fed into the fiber accumulator, continuously withdrawing the thread out of the fiber accumulator and continuously feeding fibers into the accumulator, continuously measuring thickness of the joints and automatically controlling the quantity of fibers being joined which is necessary for producing a joint having a given acceptable thickness.

2. Method according to claim 1, wherein the thickness of the joints is continuously measured by comparing a number of too-thick joints measured in a given time period with a number of too-thin joints measured in the same time period, reducing the quantity of fibers to be joined when a preponderance of the too-thick joints are measured, and increasing the quantity of fibers to be joined when a preponderance of the too-thin joints are measured, and maintaining unchanged the quantity of fibers to be joined when, within a prescribed tolerance, a substantially equal number of too-thin and too-thick joints are measured in the given time period.

3. Method according to claim 2, which includes automatically performing a continuous addition of joints exceeding the thickness tolerance, thick joints having a positive value and thin joints having a negative value and, when a prescribed difference is exceeded, automatically changing the quantity of fibers to be joined, interrupting the continuous addition and newly beginning the continuous addition once again.

4. Method according to claim 2 which includes measuring the corrected quantity of fibers provided for the respective reduction and increase in the quantity of fibers to be joined, automatically inversely proportional to the number of joints exceeding the thickness tolerance and included in the addition during at least one of the continuous and preceding addition processes.

5. Method according to claim 2 which includes measuring the corrected quantity of fibers provided for the respective reduction and increase in the quantity of fibers to be joined, automatically inversely proportional to the number of all of the joints measured during an addition process which has just ended.

6. Method according to claim 2 which includes measuring the corrected quantity of fibers provided for the respective reduction and increase in the quantity of fibers to be joined, automatically proportional to a mean thread signal of the joints measured during an addition process which has just ended.

7. Method according to claim 2 which includes maintaining a prescribed corrected quantity of fibers within tolerance limits with each change of the quantity of fibers to be joined.

8. Method according to claim 1 which includes measuring the thickness the joints by determining the mass per unit length for each joint, forming a mean value from the measured values of a plurality of the joints and comparing it with the mass per unit length of the thread, and changing the quantity of fibers to be joined in proportion with the deviation in the mass.

9. Method according to claim 8 which includes measuring the mass per unit length at the traveling thread.

10. Joining device capable of traveling and forming a joint in an open-end spinning machine having a sliver drawing-in device for drawing in a sliver and feeding it to a fiber loosening device, a fiber guiding device for guiding the sliver then to a fiber accumulator for accumulating, disentangling, imparting a rotary motion to, and thereafter engaging the sliver with an open end of a thread, a take-up device for drawing the thread out of the fiber accumulator, means for feeding a thread end, for the purpose of forming a joint, back into the fiber accumulator into contact with a quantity of fibers to be joined which had been previously fed into the fiber accumulator, means for continuously withdrawing the thread from the fiber accumularot and means for continuously feeding fibers into the fiber accumulator the joining device comprising an automatic joint thickness measuring device connected to a joint thickness monitor, and a metering device for quantities of fibers to be joined which is controllable in accordance with a mean thickness of the joints, said metering device being operatively connected to said thickness monitor.

11. Joining device according to claim 10 wherein said metering device for the quantities of fibers has a detachable operative connection with the silver drawing-in device of the open-end spinning machine.

12. Joining device according to claim 10 wherein said automatic joint thickness measuring device has a thread signal receiver with an output connected to a comparator responsive to at least one thread signal deviating from those for normal thread values, said comparator having an output to which a mean value former of said thickness monitor is post connected.

13. Joining device according to claim 10 wherein said joint thickness monitor has an up/down counter with an up-input connected to an output of a comparator responsive to relatively thick locations of the thread, a down-input connected to an output of a comparator responsive to relatively thin locations of the thread and forming part of said automatic joint thickness measuring device, and an output connected to said metering device for quantities of fibers to be joined.

14. Joining device according to claim 13 wherein said up/down counter is capable of emitting a fiber-quantity increasing signal when a zero value is reached and jumping to a prescribed output counter value located between zero value and a selective over-run value, and said up/down counter being capable of emitting a fiber-quantity reducing signal when said over-run value is reached and likewise jumping to said output counter value.

15. Joining device according to claim 13 including a corrected quantity adjuster connected to said metering device for quantities of fibers to be joined.

16. Joining device according to claim 15 wherein said corrected quantity adjuster is connected to said output of said thread signal receiver and to said output of said joint thickness monitor and is capable of emitting a correction signal inversely proportional to the number of joints measured during a just-ended counting process of said up/down counter.

17. Joining device according to claim 13, wherein a corrected quantity adjuster is connected to said metering device for quantities of fibers to be joined, and wherein said corrected quantity adjuster is connected to said outputs of said comparators and to said output of said joint thickness monitor, and is capable of emitting a correction signal inversely proportional to the number of joints which are beyond the thickness tolerance and which are measured during a just-ended counting process of said up/down counter.

18. Joining device according to claim 10 wherein said joint thickness monitor has at least one device for integrating the joint signals, one device for prescribing, simulating or integrating the thread signals and a comparator device post connected to both of said last-mentioned one devices.

19. Joining device according to claim 18 wherein said joint thickness monitor has a first integrator connected in a series-parallel circuit with a first comparator and a second comparator, as well as a second integrator in a series-parallel circuit with said first and said second comparators, said integrators having inputs connected to said joint thickness measuring device, and the outputs of said comparators being connected to said metering device for quantities of fibers to be joined.

20. Joining device according to claim 19 wherein said input of said first integrator is connected to a first thread signal receiver, and said input of said second integrator to a second thread signal receiver.

* * * * *